United States Patent [19]

Coles

[11] Patent Number: 4,903,571

[45] Date of Patent: Feb. 27, 1990

[54] KEY SIGNATURE ACTUATOR FOR A MUSICAL KEYBOARD

[76] Inventor: Donald K. Coles, 2505 Capitol Ave., Fort Wayne, Ind. 46806

[21] Appl. No.: 281,389

[22] Filed: Dec. 8, 1988

Related U.S. Application Data

[63] Continuation-in-part of Ser. No. 255,751, Oct. 11, 1988, which is a continuation-in-part of Ser. No. 15,718, Feb. 17, 1987, abandoned, which is a continuation-in-part of Ser. No. 921,407, Oct. 22, 1986, Pat. No. 4,750,399, which is a continuation-in-part of Ser. No. 736,701, May 22, 1985, Pat. No. 4,640,173.

[51] Int. Cl.[4] ..... G10G 7/00

[52] U.S. Cl. ..... 84/442; 84/453

[58] Field of Search ..... 84/1.01, 1.03, 1.28, 84/428, 423 R, 423 A, 442, 445, 451, 453, 473, 474, 478, DIG. 23

[56] References Cited

U.S. PATENT DOCUMENTS 2,484,930 10/1949 Cornelius ..... 84/445 X
3,890,871 6/1975 Oberheim ..... 84/1.01
4,198,890 4/1980 Massey et al. ..... 84/1.01
4,777,857 10/1988 Stewart ..... 84/1.01

OTHER PUBLICATIONS

Droman, David, *Exploring MIDI,* ComProducts, Huntington Beach, 1984, pp. 1–35.

MIDI 1.0 Detailed Specification, International MIDI Association, North Hollywood, 1985, pp. 1–30.

*Primary Examiner*—Stanley J. Witkowski

[57] ABSTRACT

When a musical keyboard is being played, "Note On" messages, each accompanied by one or more digital identifying numbers, are transmitted to a separate sound generator. A key signature actuator intercepts these transmissions and changes the numbers electronically so that the sharps or flats in a selected key signature will be automatically actuated. The messages accompanied by the changed numbers are sent on to the sound generator, where the proper sharps or flats are automatically sounded when front digitals of the keyboard are played. A uniform pitch changing parameter can also be selected. This parameter can be added to the pitch numbers before transmission to the sound generator so as to change the overall pitch of its musical output.

9 Claims, 10 Drawing Sheets

| BASIC DIATONIC NOTES | F = KEY SIG. FLATS 7 | 6 | 5 | 4 | 3 | 2 | 1 | 0 | S = KEY SIG. SHARPS 1 | 2 | 3 | 4 | 5 | 6 | 7 |
|---|---|---|---|---|---|---|---|---|---|---|---|---|---|---|---|
| B | B♭ | B♭ | B♭ | B♭ | B♭ | B♭ | B♭ | B | B | B | B | B | B | B | B♯ |
| A | A♭ | A♭ | A♭ | A♭ | A♭ | A | A | A | A | A | A | A | A♯ | A♯ | A♯ |
| G | G♭ | G♭ | G♭ | G | G | G | G | G | G | G | G♯ | G♯ | G♯ | G♯ | G♯ |
| F | F♭ | F | F | F | F | F | F | F | F♯ | F♯ | F♯ | F♯ | F♯ | F♯ | F♯ |
| E | E♭ | E♭ | E♭ | E♭ | E♭ | E♭ | E | E | E | E | E | E | E | E♯ | E♯ |
| D | D♭ | D♭ | D♭ | D♭ | D | D | D | D | D | D | D | D♯ | D♯ | D♯ | D♯ |
| C | C♭ | C♭ | C | C | C | C | C | C | C | C♯ | C♯ | C♯ | C♯ | C♯ | C♯ |
| FIG. 8 | C♭ | G♭ | D♭ | A♭ | E♭ | B♭ | F | C | G | D | A | E | B | F♯ | C♯ |

FIG. 9

| KEYBOARD FRONT DIGITALS | F = KEY SIG. FLATS 7 | 6 | 5 | 4 | 3 | 2 | 1 | 0 | S = KEY SIG. SHARPS 1 | 2 | 3 | 4 | 5 | 6 | 7 |
|---|---|---|---|---|---|---|---|---|---|---|---|---|---|---|---|
| B | -1 | -1 | -1 | -1 | -1 | -1 | -1 | 0 | 0 | 0 | 0 | 0 | 0 | 0 | +1 |
| A | -1 | -1 | -1 | -1 | -1 | 0 | 0 | 0 | 0 | 0 | 0 | 0 | +1 | +1 | +1 |
| G | -1 | -1 | -1 | 0 | 0 | 0 | 0 | 0 | 0 | 0 | +1 | +1 | +1 | +1 | +1 |
| F | -1 | 0 | 0 | 0 | 0 | 0 | 0 | 0 | +1 | +1 | +1 | +1 | +1 | +1 | +1 |
| E | -1 | -1 | -1 | -1 | -1 | -1 | 0 | 0 | 0 | 0 | 0 | 0 | 0 | +1 | +1 |
| D | -1 | -1 | -1 | -1 | 0 | 0 | 0 | 0 | 0 | 0 | 0 | +1 | +1 | +1 | +1 |
| C | -1 | -1 | 0 | 0 | 0 | 0 | 0 | 0 | 0 | +1 | +1 | +1 | +1 | +1 | +1 |

FIG. 10

| KEYBOARD BACK DIGITALS | F = KEY SIG. FLATS 7 | 6 | 5 | 4 | 3 | 2 | 1 | 0 | S = KEY SIG. SHARPS 1 | 2 | 3 | 4 | 5 | 6 | 7 |
|---|---|---|---|---|---|---|---|---|---|---|---|---|---|---|---|
| A♯ OR B♭ | -1 | +2 | +1 | +1 | +1 | +1 | +1 | 0 | 0 | 0 | 0 | 0 | -1 | -1 | +1 |
| G♯ OR A♭ | -1 | +1 | +1 | +1 | +1 | 0 | 0 | 0 | 0 | 0 | -1 | -1 | -1 | -1 | +1 |
| F♯ OR G♭ | -1 | +1 | +1 | 0 | 0 | 0 | 0 | 0 | -1 | -1 | -1 | -1 | -1 | -2 | +1 |
| D♯ OR E♭ | -1 | +1 | +1 | +1 | +1 | +1 | 0 | 0 | 0 | 0 | 0 | -1 | -1 | -1 | +1 |
| C♯ OR D♭ | -1 | +1 | +1 | +1 | 0 | 0 | 0 | 0 | 0 | -1 | -1 | -1 | -1 | -1 | +1 |

FIG. 11 U = 0 PRIMARY STANDARD PITCH NUMBERS M

| | WRITTEN NOTES AND KEYBOARD DIGITALS | | | | | | | | | | | |
|---|---|---|---|---|---|---|---|---|---|---|---|---|
| OCTAVE | C | Db | D | Eb | E | F | Gb | G | Ab | A | Bb | B |
| 6 | 96 | 97 | 98 | 99 | 100 | 101 | 102 | 103 | 104 | 105 | 106 | 107 |
| 5 | 84 | 85 | 86 | 87 | 88 | 89 | 90 | 91 | 92 | 93 | 94 | 95 |
| 4 | 72 | 73 | 74 | 75 | 76 | 77 | 78 | 79 | 80 | 81 | 82 | 83 |
| 3 | 60 | 61 | 62 | 63 | 64 | 65 | 66 | 67 | 68 | 69 | 70 | 71 |
| 2 | 48 | 49 | 50 | 51 | 52 | 53 | 54 | 55 | 56 | 57 | 58 | 59 |
| 1 | 36 | 37 | 38 | 39 | 40 | 41 | 42 | 43 | 44 | 45 | 46 | 47 |
| 0 | 24 | 25 | 26 | 27 | 28 | 29 | 30 | 31 | 32 | 33 | 34 | 35 |

FIG. 12 U = 1 SECONDARY STANDARD PITCH NUMBERS N

| | WRITTEN NOTES AND KEYBOARD DIGITALS | | | | | | | | | | | |
|---|---|---|---|---|---|---|---|---|---|---|---|---|
| OCTAVE | C | Db | D | Eb | E | F | Gb | G | Ab | A | Bb | B |
| 6 | 97 | 98 | 99 | 100 | 101 | 102 | 103 | 104 | 105 | 106 | 107 | 108 |
| 5 | 85 | 86 | 87 | 88 | 89 | 90 | 91 | 92 | 93 | 94 | 95 | 96 |
| 4 | 73 | 74 | 75 | 76 | 77 | 78 | 79 | 80 | 81 | 82 | 83 | 84 |
| 3 | 61 | 62 | 63 | 64 | 65 | 66 | 67 | 68 | 69 | 70 | 71 | 72 |
| 2 | 49 | 50 | 51 | 52 | 53 | 54 | 55 | 56 | 57 | 58 | 59 | 60 |
| 1 | 37 | 38 | 39 | 40 | 41 | 42 | 43 | 44 | 45 | 46 | 47 | 48 |
| 0 | 25 | 26 | 27 | 28 | 29 | 30 | 31 | 32 | 33 | 34 | 35 | 36 |

FIG. 13

SECONDARY STANDARD PITCH NUMBERS N

| | WRITTEN NOTES — KEYBOARD DIGITALS | | | | | | | | | | | |
|---|---|---|---|---|---|---|---|---|---|---|---|---|
| U· | C3 | Db | D3 | Eb | E3 | F3 | Gb | G3 | Ab | A3 | Bb | B3 |
| +6 | 66 | 67 | 68 | 69 | 70 | 71 | 72 | 73 | 74 | 75 | 76 | 77 |
| +5 | 65 | 66 | 67 | 68 | 69 | 70 | 71 | 72 | 73 | 74 | 75 | 76 |
| +4 | 64 | 65 | 66 | 67 | 68 | 69 | 70 | 71 | 72 | 73 | 74 | 75 |
| +3 | 63 | 64 | 65 | 66 | 67 | 68 | 69 | 70 | 71 | 72 | 73 | 74 |
| +2 | 62 | 63 | 64 | 65 | 66 | 67 | 68 | 69 | 70 | 71 | 72 | 73 |
| +1 | 61 | 62 | 63 | 64 | 65 | 66 | 67 | 68 | 69 | 70 | 71 | 72 |
| 0 | | | | | | | | | | | | |
| -1 | 59 | 60 | 61 | 62 | 63 | 64 | 65 | 66 | 67 | 68 | 69 | 70 |
| -2 | 58 | 59 | 60 | 61 | 62 | 63 | 64 | 65 | 66 | 67 | 68 | 69 |
| -3 | 57 | 58 | 59 | 60 | 61 | 62 | 63 | 64 | 65 | 66 | 67 | 68 |
| -4 | 56 | 57 | 58 | 59 | 60 | 61 | 62 | 63 | 64 | 65 | 66 | 67 |
| -5 | 55 | 56 | 57 | 58 | 59 | 60 | 61 | 62 | 63 | 64 | 65 | 66 |
| -6 | 54 | 55 | 56 | 57 | 58 | 59 | 60 | 61 | 62 | 63 | 64 | 65 |
| -7 | 53 | 54 | 55 | 56 | 57 | 58 | 59 | 60 | 61 | 62 | 63 | 64 |

FIG. 14

| N | VIBR. FREQ. |
|---|---|
| 71 | 493.88 |
| 70 | 466.16 |
| 69 | 440.00 |
| 68 | 415.30 |
| 67 | 392.00 |
| 66 | 369.99 |
| 65 | 349.23 |
| 64 | 329.63 |
| 63 | 311.13 |
| 62 | 293.66 |
| 61 | 277.18 |
| 60 | 261.63 |
| 59 | 246.94 |
| 58 | 233.08 |

FIG. 15

| BASIC NOTES – FRONT DIGITALS | | PITCH CHANGING PARAMETER U = 0 | | | | | | | |
|---|---|---|---|---|---|---|---|---|---|
| | | S = KEY SIGNATURE SHARPS | | | | | | | |
| | | 0 | 1 | 2 | 3 | 4 | 5 | 6 | 7 |
| C | 72 | 72 1 | 72 1 | 73 2 | 73 2 | 73 2 | 73 2 | 73 2 | 73 1 |
| B | 71 | 71 2 | 71 2 | 71 2 | 71 2 | 71 2 | 71 1 | 71 1 | 72 2 |
| A | 69 | 69 2 | 69 2 | 69 2 | 69 1 | 69 1 | 70 2 | 70 2 | 70 2 |
| G | 67 | 67 2 | 67 1 | 67 1 | 68 2 | 68 2 | 68 2 | 68 2 | 68 2 |
| F | 65 | 65 1 | 66 2 | 66 2 | 66 2 | 66 2 | 66 2 | 66 1 | 66 1 |
| E | 64 | 64 2 | 64 2 | 64 2 | 64 2 | 64 1 | 64 1 | 65 2 | 65 2 |
| D | 62 | 62 2 | 62 2 | 62 1 | 62 1 | 63 2 | 63 2 | 63 2 | 63 2 |
| C | 60 | 60 | 60 | 61 | 61 | 61 | 61 | 61 | 61 |
| KEYNOTE | | C | G | D | A | E | B | F# | C# |

FIG. 16

| BASIC NOTES – FRONT DIGITALS | | PITCH CHANGING PARAMETER U = 1 | | | | | | | |
|---|---|---|---|---|---|---|---|---|---|
| | | S = KEY SIGNATURE SHARPS | | | | | | | |
| | | 0 | 1 | 2 | 3 | 4 | 5 | 6 | 7 |
| C | 72 | 73 1 | 73 1 | 74 2 | 74 2 | 74 2 | 74 2 | 74 2 | 74 1 |
| B | 71 | 72 2 | 72 2 | 72 2 | 72 2 | 72 2 | 72 1 | 72 1 | 73 2 |
| A | 69 | 70 2 | 70 2 | 70 2 | 70 1 | 70 1 | 71 2 | 71 2 | 71 2 |
| G | 67 | 68 2 | 68 1 | 68 1 | 69 2 | 69 2 | 69 2 | 69 2 | 69 2 |
| F | 65 | 66 1 | 67 2 | 67 2 | 67 2 | 67 2 | 67 2 | 67 1 | 67 1 |
| E | 64 | 65 2 | 65 2 | 65 2 | 65 2 | 65 1 | 65 1 | 66 2 | 66 2 |
| D | 62 | 63 2 | 63 2 | 63 1 | 63 1 | 64 2 | 64 2 | 64 2 | 64 2 |
| Ċ | 60 | 61 | 61 | 62 | 62 | 62 | 62 | 62 | 62 |
| KEYNOTE | | C | G | D | A | E | B | F# | C# |

FIG. 17
| CHROMATIC NOTES — BACK DIGITALS | | PITCH CHANGING PARAMETER U = 0 | | | | | | | |
|---|---|---|---|---|---|---|---|---|---|
| | | S = KEY SIGNATURE SHARPS | | | | | | | |
| | | 0 | 1 | 2 | 3 | 4 | 5 | 6 | 7 |
| C# | 73 | 73 | 73 | 72 | 72 | 72 | 72 | 72 | 74 |
| | | 3 | 3 | 2 | 2 | 2 | 3 | 3 | 3 |
| A# | 70 | 70 | 70 | 70 | 70 | 70 | 69 | 69 | 71 |
| | | 2 | 2 | 2 | 3 | 3 | 2 | 2 | 2 |
| G# | 68 | 68 | 68 | 68 | 67 | 67 | 67 | 67 | 69 |
| | | 2 | 3 | 3 | 2 | 2 | 2 | 3 | 2 |
| F# | 66 | 66 | 65 | 65 | 65 | 65 | 65 | 64 | 67 |
| | | 3 | 2 | 2 | 2 | 3 | 3 | 2 | 3 |
| D# | 63 | 63 | 63 | 63 | 63 | 62 | 62 | 62 | 64 |
| | | 2 | 2 | 3 | 3 | 2 | 2 | 2 | 2 |
| C# | 61 | 61 | 61 | 60 | 60 | 60 | 60 | 60 | 62 |
| KEYNOTE | | C | G | D | A | E | B | F# | C# |
FIG. 18
| CHROMATIC NOTES — BACK DIGITALS | | PITCH CHANGING PARAMETER U = 0 | | | | | | | |
|---|---|---|---|---|---|---|---|---|---|
| | | F = KEY SIGNATURE FLATS | | | | | | | |
| | | 0 | 1 | 2 | 3 | 4 | 5 | 6 | 7 |
| Db | 73 | 73 | 73 | 73 | 73 | 74 | 74 | 74 | 72 |
| | | 3 | 2 | 2 | 2 | 3 | 3 | 2 | 3 |
| Bb | 70 | 70 | 71 | 71 | 71 | 71 | 71 | 72 | 69 |
| | | 2 | 3 | 3 | 2 | 2 | 2 | 3 | 2 |
| Ab | 68 | 68 | 68 | 68 | 69 | 69 | 69 | 69 | 67 |
| | | 2 | 2 | 2 | 3 | 3 | 2 | 2 | 2 |
| Gb | 66 | 66 | 66 | 66 | 66 | 66 | 67 | 67 | 65 |
| | | 3 | 3 | 2 | 2 | 2 | 3 | 3 | 3 |
| Eb | 63 | 63 | 63 | 64 | 64 | 64 | 64 | 64 | 62 |
| | | 2 | 2 | 3 | 3 | 2 | 2 | 2 | 2 |
| Db | 61 | 61 | 61 | 61 | 61 | 62 | 62 | 62 | 60 |
| KEYNOTE | | C | F | Bb | Eb | Ab | Db | Gb | Cb |
FIG. 19
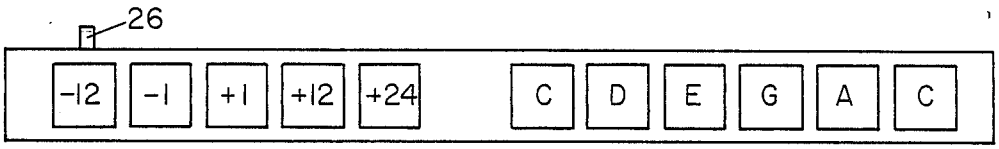
FIG. 20
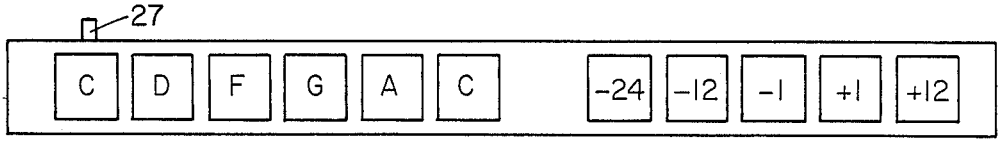

FIG. 21

| WRITTEN NOTES– KEYBOARD DIGITALS | | F = KEY SIG. FLATS | | | | | | | S = KEY SIG. SHARPS | | | | | | | |
|---|---|---|---|---|---|---|---|---|---|---|---|---|---|---|---|---|
| | | 7 | 6 | 5 | 4 | 3 | 2 | 1 | 0 | 1 | 2 | 3 | 4 | 5 | 6 | 7 |
| | | | | | | | | | U = 0 | | | | | | | |
| C5 | 84 | 83 | 83 | 84 | 84 | 84 | 84 | 84 | 84 | 84 | 85 | 85 | 85 | 85 | 85 | 85 |
| B4 | 83 | 82 | 82 | 82 | 82 | 82 | 82 | 82 | 83 | 83 | 83 | 83 | 83 | 83 | 83 | 84 |
| | 82 | 81 | 84 | 83 | 83 | 83 | 83 | 83 | 82 | 82 | 82 | 82 | 82 | 81 | 81 | 83 |
| A4 | 81 | 80 | 80 | 80 | 80 | 80 | 81 | 81 | 81 | 81 | 81 | 81 | 81 | 82 | 82 | 82 |
| | 80 | 79 | 81 | 81 | 81 | 81 | 80 | 80 | 80 | 80 | 80 | 79 | 79 | 79 | 79 | 81 |
| G4 | 79 | 78 | 78 | 78 | 79 | 79 | 79 | 79 | 79 | 79 | 79 | 80 | 80 | 80 | 80 | 80 |
| | 78 | 77 | 79 | 79 | 78 | 78 | 78 | 78 | 78 | 77 | 77 | 77 | 77 | 77 | 76 | 79 |
| F4 | 77 | 76 | 77 | 77 | 77 | 77 | 77 | 77 | 77 | 78 | 78 | 78 | 78 | 78 | 78 | 78 |
| E4 | 76 | 75 | 75 | 75 | 75 | 75 | 75 | 76 | 76 | 76 | 76 | 76 | 76 | 76 | 77 | 77 |
| | 75 | 74 | 76 | 76 | 76 | 76 | 76 | 75 | 75 | 75 | 75 | 75 | 74 | 74 | 74 | 76 |
| D4 | 74 | 73 | 73 | 73 | 73 | 74 | 74 | 74 | 74 | 74 | 74 | 74 | 75 | 75 | 75 | 75 |
| | 73 | 72 | 74 | 74 | 74 | 73 | 73 | 73 | 73 | 73 | 72 | 72 | 72 | 72 | 72 | 74 |
| C4 | 72 | 71 | 71 | 72 | 72 | 72 | 72 | 72 | 72 | 72 | 73 | 73 | 73 | 73 | 73 | 73 |
| B3 | 71 | 70 | 70 | 70 | 70 | 70 | 70 | 70 | 71 | 71 | 71 | 71 | 71 | 71 | 71 | 72 |
| | 70 | 69 | 72 | 71 | 71 | 71 | 71 | 71 | 70 | 70 | 70 | 70 | 70 | 69 | 69 | 71 |
| A3 | 69 | 68 | 68 | 68 | 68 | 68 | 69 | 69 | 69 | 69 | 69 | 69 | 69 | 70 | 70 | 70 |
| | 68 | 67 | 69 | 69 | 69 | 69 | 68 | 68 | 68 | 68 | 68 | 67 | 67 | 67 | 67 | 69 |
| G3 | 67 | 66 | 66 | 66 | 67 | 67 | 67 | 67 | 67 | 67 | 67 | 68 | 68 | 68 | 68 | 68 |
| | 66 | 65 | 67 | 67 | 66 | 66 | 66 | 66 | 66 | 65 | 65 | 65 | 65 | 65 | 64 | 67 |
| F3 | 65 | 64 | 65 | 65 | 65 | 65 | 65 | 65 | 65 | 66 | 66 | 66 | 66 | 66 | 66 | 66 |
| E3 | 64 | 63 | 63 | 63 | 63 | 63 | 63 | 64 | 64 | 64 | 64 | 64 | 64 | 64 | 65 | 65 |
| | 63 | 62 | 64 | 64 | 64 | 64 | 64 | 63 | 63 | 63 | 63 | 63 | 62 | 62 | 62 | 64 |
| D3 | 62 | 61 | 61 | 61 | 61 | 62 | 62 | 62 | 62 | 62 | 62 | 62 | 63 | 63 | 63 | 63 |
| | 61 | 60 | 62 | 62 | 62 | 61 | 61 | 61 | 61 | 61 | 60 | 60 | 60 | 60 | 60 | 62 |
| C3 | 60 | 59 | 59 | 60 | 60 | 60 | 60 | 60 | 60 | 60 | 61 | 61 | 61 | 61 | 61 | 61 |
| B2 | 59 | 58 | 58 | 58 | 58 | 58 | 58 | 58 | 59 | 59 | 59 | 59 | 59 | 59 | 59 | 60 |
| | 58 | 57 | 60 | 59 | 59 | 59 | 59 | 59 | 58 | 58 | 58 | 58 | 58 | 57 | 57 | 59 |
| A2 | 57 | 56 | 56 | 56 | 56 | 56 | 57 | 57 | 57 | 57 | 57 | 57 | 57 | 58 | 58 | 58 |
| | 56 | 55 | 57 | 57 | 57 | 57 | 56 | 56 | 56 | 56 | 56 | 55 | 55 | 55 | 55 | 57 |
| G2 | 55 | 54 | 54 | 54 | 55 | 55 | 55 | 55 | 55 | 55 | 55 | 56 | 56 | 56 | 56 | 56 |
| | 54 | 53 | 55 | 55 | 54 | 54 | 54 | 54 | 54 | 53 | 53 | 53 | 53 | 53 | 52 | 55 |
| F2 | 53 | 52 | 53 | 53 | 53 | 53 | 53 | 53 | 53 | 54 | 54 | 54 | 54 | 54 | 54 | 54 |
| E2 | 52 | 51 | 51 | 51 | 51 | 51 | 51 | 52 | 52 | 52 | 52 | 52 | 52 | 52 | 53 | 53 |
| | 51 | 50 | 52 | 52 | 52 | 52 | 52 | 51 | 51 | 51 | 51 | 51 | 50 | 50 | 50 | 52 |
| D2 | 50 | 49 | 49 | 49 | 49 | 50 | 50 | 50 | 50 | 50 | 50 | 50 | 51 | 51 | 51 | 51 |
| | 49 | 48 | 50 | 50 | 50 | 49 | 49 | 49 | 49 | 49 | 48 | 48 | 48 | 48 | 48 | 50 |
| C2 | 48 | 47 | 47 | 48 | 48 | 48 | 48 | 48 | 48 | 48 | 49 | 49 | 49 | 49 | 49 | 49 |
| KEY NOTE | | C♭ | G♭ | D♭ | A♭ | E♭ | B♭ | F | C | G | D | A | E | B | F♯ | C♯ |

| WRITTEN NOTES— KEYBOARD DIGITALS | | F = KEY SIG. FLATS | | | | | | | | S = KEY SIG. SHARPS | | | | | | |
|---|---|---|---|---|---|---|---|---|---|---|---|---|---|---|---|---|
| | | 7 | 6 | 5 | 4 | 3 | 2 | 1 | 0 | 1 | 2 | 3 | 4 | 5 | 6 | 7 |
| | | U = 1 | | | | | | | | | | | | | | |
| C5 | 84 | 84 | 84 | 85 | 85 | 85 | 85 | 85 | 85 | 85 | 86 | 86 | 86 | 86 | 86 | 86 |
| B4 | 83 | 83 | 83 | 83 | 83 | 83 | 83 | 83 | 84 | 84 | 84 | 84 | 84 | 84 | 84 | 85 |
| | 82 | 82 | 85 | 84 | 84 | 84 | 84 | 84 | 83 | 83 | 83 | 83 | 83 | 82 | 82 | 84 |
| A4 | 81 | 81 | 81 | 81 | 81 | 81 | 82 | 82 | 82 | 82 | 82 | 82 | 82 | 83 | 83 | 83 |
| | 80 | 80 | 82 | 82 | 82 | 82 | 81 | 81 | 81 | 81 | 81 | 80 | 80 | 80 | 80 | 82 |
| G4 | 79 | 79 | 79 | 79 | 80 | 80 | 80 | 80 | 80 | 80 | 80 | 81 | 81 | 81 | 81 | 81 |
| | 78 | 78 | 80 | 80 | 79 | 79 | 79 | 79 | 79 | 78 | 78 | 78 | 78 | 78 | 77 | 80 |
| F4 | 77 | 77 | 78 | 78 | 78 | 78 | 78 | 78 | 78 | 79 | 79 | 79 | 79 | 79 | 79 | 79 |
| E4 | 76 | 76 | 76 | 76 | 76 | 76 | 76 | 77 | 77 | 77 | 77 | 77 | 77 | 77 | 78 | 78 |
| | 75 | 75 | 77 | 77 | 77 | 77 | 77 | 76 | 76 | 76 | 76 | 76 | 75 | 75 | 75 | 77 |
| D4 | 74 | 74 | 74 | 74 | 74 | 75 | 75 | 75 | 75 | 75 | 75 | 75 | 76 | 76 | 76 | 76 |
| | 73 | 73 | 75 | 75 | 75 | 74 | 74 | 74 | 74 | 74 | 73 | 73 | 73 | 73 | 73 | 75 |
| C4 | 72 | 72 | 72 | 73 | 73 | 73 | 73 | 73 | 73 | 73 | 74 | 74 | 74 | 74 | 74 | 74 |
| B3 | 71 | 71 | 71 | 71 | 71 | 71 | 71 | 71 | 72 | 72 | 72 | 72 | 72 | 72 | 72 | 73 |
| | 70 | 70 | 73 | 72 | 72 | 72 | 72 | 72 | 71 | 71 | 71 | 71 | 71 | 70 | 70 | 72 |
| A3 | 69 | 69 | 69 | 69 | 69 | 69 | 70 | 70 | 70 | 70 | 70 | 70 | 70 | 71 | 71 | 71 |
| | 68 | 68 | 70 | 70 | 70 | 70 | 69 | 69 | 69 | 69 | 69 | 68 | 68 | 68 | 68 | 70 |
| G3 | 67 | 67 | 67 | 67 | 68 | 68 | 68 | 68 | 68 | 68 | 68 | 69 | 69 | 69 | 69 | 69 |
| | 66 | 66 | 68 | 68 | 67 | 67 | 67 | 67 | 67 | 66 | 66 | 66 | 66 | 66 | 65 | 68 |
| F3 | 65 | 65 | 66 | 66 | 66 | 66 | 66 | 66 | 66 | 67 | 67 | 67 | 67 | 67 | 67 | 67 |
| E3 | 64 | 64 | 64 | 64 | 64 | 64 | 64 | 65 | 65 | 65 | 65 | 65 | 65 | 65 | 66 | 66 |
| | 63 | 63 | 65 | 65 | 65 | 65 | 65 | 64 | 64 | 64 | 64 | 64 | 63 | 63 | 63 | 65 |
| D3 | 62 | 62 | 62 | 62 | 62 | 63 | 63 | 63 | 63 | 63 | 63 | 63 | 64 | 64 | 64 | 64 |
| | 61 | 61 | 63 | 63 | 63 | 62 | 62 | 62 | 62 | 62 | 61 | 61 | 61 | 61 | 61 | 63 |
| C3 | 60 | 60 | 60 | 61 | 61 | 61 | 61 | 61 | 61 | 61 | 62 | 62 | 62 | 62 | 62 | 62 |
| KEYNOTE | | Cb | Gb | Db | Eb | Ab | Bb | F | C | G | D | A | E | B | F# | C# |

| | |
|---|---|
| NOTE | C |
| PLAY | 2 |

| | | | | | | | | | | | | | | | | |
|---|---|---|---|---|---|---|---|---|---|---|---|---|---|---|---|---|
| NOTE | C | B | B | C | C | C | C | C | C | C | c | c | c | c | c | c |
| PLAY | 2 | 1 | 1 | 2 | 2 | 2 | 2 | 2 | 2 | 2 | 2 | 2 | 2 | 2 | 2 | 2 |

| | |
|---|---|
| NOTE | c |
| PLAY | 2 |

| | | | | | | | | | | | | | | | | |
|---|---|---|---|---|---|---|---|---|---|---|---|---|---|---|---|---|
| NOTE | c | C | D | D | D | c | c | c | c | c | C | C | C | C | C | D |
| PLAY | 2 | 2 | 2 | 2 | 2 | 2 | 2 | 2 | 2 | 2 | 2 | 2 | 2 | 2 | 2 | 2 |

FIG. 29

| CHROMATIC NOTES | F = KEY SIG. FLATS | | | | | | | | S = KEY SIG. SHARPS | | | | | | |
|---|---|---|---|---|---|---|---|---|---|---|---|---|---|---|---|
| | 7 | 6 | 5 | 4 | 3 | 2 | 1 | 0 | 1 | 2 | 3 | 4 | 5 | 6 | 7 |
| b | A | C | B | B | B | B | B | b | b | b | b | b | A | A | B |
| a | G | A | A | A | A | a | a | a | a | a | G | G | G | G | A |
| f | F | G | G | f | f | f | f | f | F | F | F | F | F | E | G |
| e | D | E | E | E | E | E | e | e | e | e | e | D | D | D | E |
| c | C | D | D | D | c | c | c | c | c | C | C | C | C | C | D |
| KEYNOTE | C♭ | | | | | | | C | | | | | | | C♯ |

FIG. 30

| | | |
|---|---|---|
| NOTE | CH | |
| SPLT | 1 | |

FIG. 31

| | | |
|---|---|---|
| NOTE | CH | CC |
| SPLT | 1 | 25 |

FIG. 32

| | | | | | | | | | | | | | | | | | |
|---|---|---|---|---|---|---|---|---|---|---|---|---|---|---|---|---|---|
| NOTE | !! | | 1 | 2 | 3 | 4 | 5 | 6 | 7 | 8 | 9 | 0 | 1 | 2 | 3 | 4 | 5 | 6 |
| SPLT | 1 | | * | * | * | * | * | * | * | * | * | * | * | * | * | * | * | * |
| | FLATS | 7 | 6 | 5 | 4 | 3 | 2 | 1 | 0 | 1 | 2 | 3 | 4 | 5 | 6 | 7 | SHARPS |

FIG. 33

| | | | | | | | | | | | | | | | | | |
|---|---|---|---|---|---|---|---|---|---|---|---|---|---|---|---|---|---|
| NOTE | !! | | 1 | 2 | 3 | 4 | 5 | 6 | 7 | 8 | 9 | 0 | 1 | 2 | 3 | 4 | 5 | 6 |
| SPLT | 1 | | * | | | | | | | | | | | | | | | |
| | FLATS | 7 | 6 | 5 | 4 | 3 | 2 | 1 | 0 | 1 | 2 | 3 | 4 | 5 | 6 | 7 | SHARPS |

FIG. 34

| | | | | | | | | | | | | | | | | | |
|---|---|---|---|---|---|---|---|---|---|---|---|---|---|---|---|---|---|
| NOTE | !! | | 1 | 2 | 3 | 4 | 5 | 6 | 7 | 8 | 9 | 0 | 1 | 2 | 3 | 4 | 5 | 6 |
| SPLT | 2 | | | * | | | | | | | | | | | | | | |
| | FLATS | 7 | 6 | 5 | 4 | 3 | 2 | 1 | 0 | 1 | 2 | 3 | 4 | 5 | 6 | 7 | SHARPS |

FIG. 35

| | | | | | | | | | | | | | | | | | |
|---|---|---|---|---|---|---|---|---|---|---|---|---|---|---|---|---|---|
| NOTE | !! | | 1 | 2 | 3 | 4 | 5 | 6 | 7 | 8 | 9 | 0 | 1 | 2 | 3 | 4 | 5 | 6 |
| SPLT | 12 | | | | | | | | | | | | | * | | | | |
| | FLATS | 7 | 6 | 5 | 4 | 3 | 2 | 1 | 0 | 1 | 2 | 3 | 4 | 5 | 6 | 7 | SHARPS |

FIG. 36

| | | | | | | | | | | | | | | | | | |
|---|---|---|---|---|---|---|---|---|---|---|---|---|---|---|---|---|---|
| RUN | | | 1 | 2 | 3 | 4 | 5 | 6 | 7 | 8 | 9 | 0 | 1 | 2 | 3 | 4 | 5 | 6 |
| MIXER | | | * | * | * | * | * | * | * | * | * | S | * | * | * | * | * | * |
| | FLATS | 7 | 6 | 5 | 4 | 3 | 2 | 1 | 0 | 1 | 2 | 3 | 4 | 5 | 6 | 7 | SHARPS |

FIG. 37

| | | | | | | | | | | | | | | | | | |
|---|---|---|---|---|---|---|---|---|---|---|---|---|---|---|---|---|---|
| NOTE | !! | 1 | 2 | 3 | 4 | 5 | 6 | 7 | 8 | 9 | 0 | 1 | 2 | 3 | 4 | 5 | 6 |
| SPLT | 2 | | | * | | | | | | | | | | | | | |
| FLATS | 7 | 6 | 5 | 4 | 3 | 2 | 1 | 0 | 1 | 2 | 3 | 4 | 5 | 6 | 7 | SHARPS | |

FIG. 38

| | | | | | | | | | | | | | | | | | |
|---|---|---|---|---|---|---|---|---|---|---|---|---|---|---|---|---|---|
| NOTE | !! | 1 | 2 | 3 | 4 | 5 | 6 | 7 | 8 | 9 | 0 | 1 | 2 | 3 | 4 | 5 | 6 |
| SPLT | 3 | | | | | * | | | | | | | | | | | |
| FLATS | 7 | 6 | 5 | 4 | 3 | 2 | 1 | 0 | 1 | 2 | 3 | 4 | 5 | 6 | 7 | SHARPS | |

FIG. 39

| | | | | | | | | | | | | | | | | |
|---|---|---|---|---|---|---|---|---|---|---|---|---|---|---|---|---|
| RUN | 1 | 2 | 3 | 4 | 5 | 6 | 7 | 8 | 9 | 0 | 1 | 2 | 3 | 4 | 5 | 6 |
| MIXER | * | S | * | * | * | * | * | * | * | * | * | * | * | * | * | * |
| | Cb | Db | Eb | F | Gb | Ab | Bb | C | D | E | F# | G | A | B | C# | |

FIG. 40

| | | | | | | | | | | | | | | | | |
|---|---|---|---|---|---|---|---|---|---|---|---|---|---|---|---|---|
| RUN | 1 | 2 | 3 | 4 | 5 | 6 | 7 | 8 | 9 | 0 | 1 | 2 | 3 | 4 | 5 | 6 |
| MIXER | * | * | S | * | * | * | * | * | * | * | * | * | * | * | * | * |
| | Cb | Db | Eb | F | Gb | Ab | Bb | C | D | E | F# | G | A | B | C# | |

KEY SIGNATURE ACTUATOR FOR A MUSICAL KEYBOARD

CROSS-REFERENCE TO RELATED APPLICATIONS

This application is a continuation-in-part of U.S. application Ser. No. 255,751, filed 10-11-88, which is a continuation-in-part of U.S. application Ser. No. 015,718 filed 2-17-87, abandoned which is a continuation-in-part of U.S. application Ser. No. 921,407 filed 10-22-86, U.S. Pat. No. 4,750,399, which is a continuation-in-part of U.S. patent application Ser. No. 736,701 filed 5-22-85, U.S. Pat. No. 4,640,173.

BACKGROUND OF THE INVENTION

1. Field of the Invention

A key signature actuator for a musical keyboard eases playing from musical compositions written with difficult key signatures without reprinting the music, by changing the keyboard fingering of the musical compositions.

A uniform pitch changer for a musical keyboard, without changing the keyboard fingering of a musical composition, changes each tone of the musical composition by the same musical interval.

2. Description of the Prior Art

The traditional way of writing Western music is to position musical notes on a set of parallel lines. In each octave, seven musical notes represent the seven tones of a basic diatonic scale, the other five tones of the twelve-tone scale being referred to the notes of the basic diatonic scale by means of sharp or flat symbols which serve as corrections to the basic diatonic notes. Thus a "chromatic" tone intermediate to the C and D tones is represented as C sharp or D flat.

Since the most commonly grouped tones in music are the seven tones of the diatonic scale, our traditional musical keyboard was structured so as to play the basic diatonic scale on its front digitals and the other five tones, which constitute the tonal pentatonic scale, on its back digitals. The notes of written keyboard music are normally interpreted as instructions to play particular digitals of the keyboard. The major mode of the diatonic scale, starting with a C note, is played on a C front digital. The succeeding D, E, F, G, A, B notes of the diatonic scale are played on the succeeding D, E, F, G, A, B front digitals. The notes of written music can thus be interpreted as instructions to play particular digitals of the keyboard, each front and back digital of the keyboard identified by a note in the written music and serving to identify that musical note. This arrangement had the original advantage that the most commonly grouped notes were played on the wide front digitals of the keyboard.

Since people come in all sizes and shapes there can be no universal agreement on exactly which are the best wave lengths for sound waves in the air, but people can agree much better on the relative pitches of sequentially sounded musical tones. Thus if a uniform pitch changer in a keyboard is used to raise all the tones sounded by all of its digitals same musical interval, since it does not affect the relative musical intervals between the tones of a musical composition, for example, it will be universally recognized after the uniform change of pitch as the same musical composition.

Many musical instruments contain uniform pitch changers, but many do not. For a tonal musical composition to sound its best and to be playable on all instruments, therefore, it is usually necessary to start the major mode of its diatonic scale on some note of the twelve-tone scale other than C. In written music this necessitates correction of one or more of the seven notes of the basic diatonic scale by means of a sharp or flat symbol. The composer finds it convenient to specify the basic diatonic note corrections by means of a key signature that is placed at the front of each line of written music. Key signatures greatly reduce the effort needed to write modern music in other keys than C, and to understand the written music.

In earlier times, a change in the overall output pitch of a musical composition meant that the composition was being played in a different musical key. But in modern times, with the wide use of uniform pitch changers, there is no longer a one-to-one correspondence between the overall pitch of a musical composition as sounded and the key in which the composition is written and played.

The note corrections in a key signature of written music require playing of the back digitals of a keyboard. This detracts from the previous virtue of the traditional keyboard, of providing wide front digitals for the most commonly played notes. Furthermore, the ordinary keyboard player has difficulty remembering and playing all the sharps and flats called for in the fourteen key signatures. Music publishers have reprinted some of the older music with easier key signatures, but the reprinted music usually does not sound as good as when it is played in its original key, and it is usually harder to sing.

It would be possible to reprint all music in the key of C for the benefit of musicians having uniform pitch changers, but many instruments in a band or orchestra do not have uniform pitch changers, so they must play from the music as originally written. Thus uniform pitch changers and the reprinting of music do not provide an adequate solution to the problem of difficult key signatures.

To alleviate these difficulties, a keyboard instrument can be provided with a device to automatically actuate the tone corrections specified in the key signature. Such a device, which I call a key signature actuator, was disclosed by Martin Phillips in 1886 (U.S. Pat. Nos. 354,733, 466,907, and 519,071). If, for example, the device was set for a key signature with one sharp, then the F front digital would sound not the F tone but the F sharp tone instead, as called out in the key signature. This century-old key signature actuator has not been widely used because of its mechanical complexity and expense.

As opposed to uniform pitch changers, most key signature actuators change the musical intervals between the tones sounded by a given sequence of digitals. For example, when the F front digital is made to sound the F sharp tone the interdigital musical interval between the E and F front digitals is changed from one semitone to two semitones, and the interdigital musical interval between the F and G front digitals is changed from two semitones to one semitone. A consequence of this difference between a key signature actuator and a uniform pitch changer is that key signature actuators are generally more difficult to construct, and they are not widely available.

Whereas the function of a uniform pitch changer is usually to change the overall pitch of the output music away from the pitch of the written music, the function of a key signature actuator is to ease playing from music written with difficult key signatures without rewriting the music.

A key signature actuator greatly reduces the mechanical difficulty of playing in other keys than C, because it changes the fingering of a musical composition; the most frequently occurring notes are again played on the wide front digitals of the keyboard. The mental difficulty of playing music is also reduced, because the musician can play the notes as they appear in the body of the written music, unmodified by its key signature. If key signature actuators were available commercially, then a musical composition could more generally be printed in the musical key in which it sounds best and is most easily sung. This better music could then be played by inexpert players on electronic musical instruments having key signature actuators. More expert musicians having acoustic instruments without key signature actuators could also play the better music. Improvements in key signature actuators are disclosed in my U.S. Pat. Nos. 3,986,422, 4,048,893, 4,640,173, and 4,750,399, and my copending application Ser. No. 166,464, filed 3-10-88, U.S. Pat. No. 4,821,619.

In modern musical practice it is common to have a musical keyboard and a sound generator in different places, the keyboard transmitting binary coded messages to the sound generator on a pair of wires. When a single digital of the keyboard is pressed, a "Note On" message is transmitted in binary code to the sound module, accompanied by a number which identifies the keyboard digital and the note in written music that it is playing. This message tells the sound module to generate a musical tone of the proper pitch. When the keyboard digital is released, a "Note Off" message, accompanied by the note and digital identifying number, can be transmitted to the sound module, and the musical tone will be discontinued. Musical instrument manufacturers have established an international standard for such communication, called "Musical Instrument Digital Interface" (MIDI).

My copending patent application Ser. No. 255,751 discloses a new use for the MIDI interface whereby MIDI transmission to a sound generator is intercepted and the numbers changed in accordance with a selected key signature, the pitch numbers transmitted to the sound generator resulting in automatic actuation of the key signature. In any musical key the key signature actuator allows all of the tonal diatonic notes to be played on the front digitals of a musical keyboard, and the non-diatonic notes to be played on the back digitals. The keyboard requires two extra back digitals per octave span.

SUMMARY OF THE INVENTION

A musical keyboard having seven front digitals and five back digitals per octave span transmits messages to a separate sound generator, telling it to generate tones in accord with notes of written music and the keyboard digitals that are playing them. The keyboard transmits a "Note On" message accompanied by one or more note and digital identifying numbers, using a standard method called "Musical Instrument Digital Interface" (MIDI), this message being transmitted in binary code serially on a single pair of wires.

A musical key signature actuating apparatus intercepts this kind of transmission. The apparatus contains a message decoder and a number changer which can change the numbers transmitted to the sound generator so that a sequence of note and digital identifying numbers from the front digitals of the keyboard can sound the diatonic scale in any selected one of fifteen different musical keys, with the sharps or flats in its key signature automatically actuated. After selecting a key signatue of written music, a keyboard musician can play musical notes as they appear in the body of the written music, unmodified by any key signature. A uniform pitch changing parameter can also be selected. This parameter can be added to the pitch numbers before transmission to the sound generator so as to change the overall pitch of its musical output. The apparatus can be used with other MIDI equipped musical instruments such as wind instruments or guitars.

One object of the invention is to reduce the mental difficulty of playing from music written with difficult key signatures; the player need not constantly remember the sharps or flats specified in a key signature, so can give more attention to expressive aspects of the music.

Another object of the invention is to reduce the mechanical difficulty of playing traditional keyboard music by enabling the diatonic notes of a musical composition written in any musical key to be played on the wide front digitals of a keyboard.

A still further object of the invention is to allow music to be printed more commonly in those musical keys in which it sounds best and is most easily sung.

BRIEF DESCRIPTION OF THE DRAWINGS

FIG. 8 lists the fourteen traditional key signatures.

FIG. 9 and 10 are tables of key signature corrections to the standard pitch numbers for the key of C.

FIG. 11 is a table of primary standard pitch numbers transmitted to the sound generator in the key of C.

FIG. 12 and 13 are tables of secondary standard pitch numbers transmitted to the sound generator in the key of C.

FIG. 14 is a table of vibrational frequencies corresponding to different pitch numbers.

FIGS. 15 and 16 are tables, for eight front digitals of a keyboard, and for different key signatures, of pitch numbers and differences between consecutive pitch numbers.

FIGS. 17 and 18 are tables, for six back digitals of the keyboard, of pitch numbers and differences between consecutive pitch numbers.

FIGS. 19 and 20 show primitive musical instruments equipped with a MIDI interface.

FIGS. 21 and 23 are look-up tables of pitch numbers for both the front and the back digitals of the keyboard, for different key signatures.

FIG. 22 shows a method of selecting key signatures in accordance with their keynotes.

FIG. 29 is a table of changes produced by key signature actuation on the chromatic musical notes, which are played by back digitals of a keyboard.

FIGS. 30–35 show displays visible in the commerical equipment when arranging for selection of a key signature according to the number of its sharps or flats.

FIG. 36 shows a display visible after selecting a key signature having two sharps.

FIGS. 37 and 38 show displays visible when arranging for selection of key signatures according to their keynotes.

FIG. 39 and 40 show displays visible after selecting key signatures for the musical keys of D flat and of E flat respectively.

DESCRIPTION OF THE PREFERRED EMBODIMENT

Figure 1:
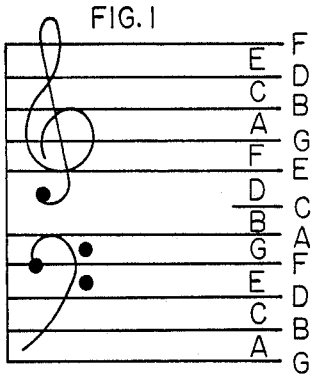
FIGS. 1–6 show music notation, including key signatures.

Traditional music notation is based on a basic diatonic scale, which has intertonal musical intervals of 2-2-1-2-2-2-1 semitones. Notation for keyboard music is shown in FIGS. 1–6. Referring to these figures, lines of the treble staff are labeled E, G, B, D, F. Spaces of this staff are labeled F, A, C, E. The musical staffs shown in FIG. 1 are used to play music written in the key of C. Music written in one of the other fourteen musical keys uses a key signature as shown in FIGS. 2–6.

Figure 2:
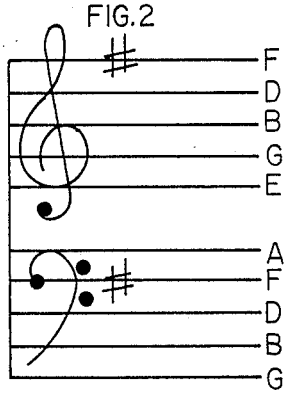
Figure 3:
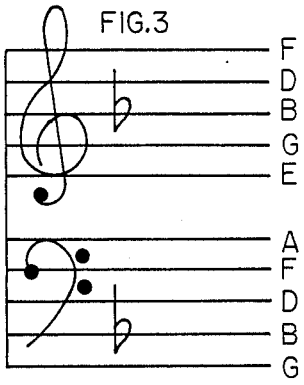

FIG. 2 shows a key signature indicating that the note F appearing in the body of the score should be corrected to F sharp. This correction allows the tonal diatonic scale to start on a G note instead of a C note. FIG. 3 shows a key signature indicating that the note B appearing in the body of the score should be corrected to B flat. This correction allows the tonal diatonic scale to start on the F note.

Figure 4:
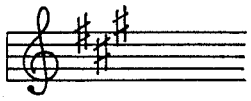
Figure 5:
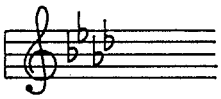

FIG. 4 shows a key signature having three sharps, which allows the tonal diatonic scale to start on the A note. FIG. 5 shows a key signature having four flats, which allows the tonal diatonic scale to start on the A flat note.

Figure 6:
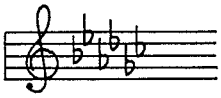

FIG. 6 shows a key signature having six flats, which allows the tonal diatonic scale to start on the G flat note. Apparatus for automatically actuating such key signatures is diagrammed in FIG. 7.

Figure 7:
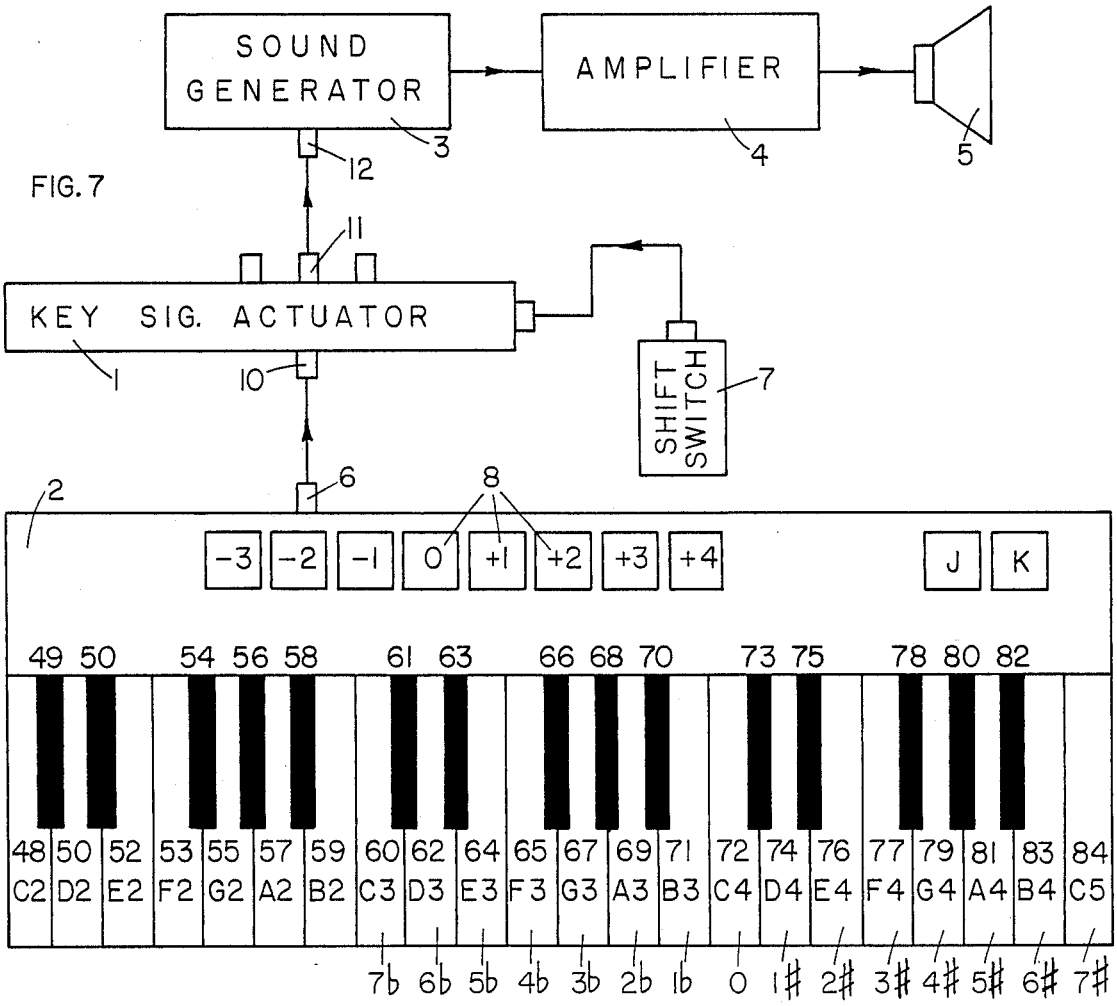
FIG. 7 is a diagram of musical apparatus for actuating key signatures.

Referring to FIG. 7, key signature actuator 1 receives messages and numbers from keyboard 2, which identify notes of written music and the keyboard digitals that are playing them. The key signature actuator immediately transmits answering messages and pitch identifying numbers to sound generator 3. The keyboard has three octaves, each containing seven front digitals and five back digitals. The front digitals in each octave of the keyboard are assigned the same letter labels as the lines and spaces of the musical staff, namely C, D, E, F, G, A, B, and notes on a musical staff are interpreted as instructions to play keyboard digitals with the same labels. When a single digital is pressed a "Note On" message accompanied by a note and digital identifying number is transmitted on output terminal 6 to the input terminal 10 of key signature actuator 1.

The key signature actuator contains a message decoder and a number changer having fifteen states corresponding to the fifteen key signatures. The number changer transforms its received note and digital identifying numbers into associated pitch numbers in accordance with a selected key signature and a selected uniform pitch changing parameter. The message and answering pitch numbers are immediately transmitted on output terminal 11 to the input terminal 12 of commercial sound generator 3. The sound module then generates a musical tone in accordance with a standard protocol named "Musical Instrument Digital Interface" (MIDI).

The music signals generated in sound module 3 are amplified in amplifier 4 and sounded by loudspeaker 5. The keyboard and sound generator are commercial units such as a Casio CZ-101 keyboard and a Yamaha TF1 tone generator. The MIDI transmitters and receivers are described in specifications which are published in the United States by the MIDI Manufacturers Association and the International MIDI Association in Los Angeles, Calif. The MIDI 1.0 Detailed Specification, page 24, section 1.3.2 assigns the number 60 to the middle C digital on an 88 digital piano keyboard. On an acoustic piano, middle A has a frequency of 440 Hz. Assuming that the piano is tuned exactly in equal temperament, with the frequency ratio of a semitone being the twelfth root of two, the middle C number 60 is equivalent to a vibration frequency of 261.63 Hz.

In principle any set of digital identifying numbers could be transmitted from the keyboard to the key signature actuator, provided that each number identifies a single digital. The set of note and digital identifying numbers shown in FIG. 7 will produce satisfactory music in a commercial sound generator even in the absence of the key signature actuator. The middle C note in written music will be played on the middle C digital of the keyboard, and it will always result in transmission of the number 60 to either key signature actuator 1 or directly to sound generator 3. A relationship between pitch numbers transmitted to the sound generator and the vibration frequencies of the resultant musical tones is shown in FIG. 14. Referring to FIG. 14, when the pitch number increases by twelve the fundamental frequency of vibration is doubled and the pitch increases by the musical interval of an octave. For each increase of pitch number by one the pitch increases by the musical interval of a semitone.

The key signature actuator also functions as a uniform pitch changer. For this purpose a uniform pitch changing parameter U is selected on pushbutton array 8 at the back of the keyboard. If the key signature actuator is set to play in the key of C and the pushbutton labeled "0" in array 8 is pressed, then when a continuous succession of musical notes is played on the keyboard, the key signature actuator will transmit to the sound module a primary standard set of pitch numbers as shown in FIG. 11.

Referring to FIG. 11, at the top of the table are shown the labels of the notes written on the musical staffs, which are also the labels of the keyboard digitals which play those notes. Notes such as D flat or E flat are played on their corresponding back digitals of the keyboard. The first column in FIG. 11 shows seven possible octaves for the written notes and the keyboard digitals. The body of the table shows the primary standard pitch numbers M, which are transmitted to the sound module when the uniform pitch changing parameter U is set to zero. These primary standard pitch numbers are equal to their corresponding note and digital identifying numbers that are received from the keyboard. For example, the primary standard pitch number for the middle C note and the middle C digital is 60.

To raise the overall pitch of the output music by a semitone we press the pushbutton labeled "1" on the array 8 at the back of the keyboard. This affects the operation of the key signature actuator, but leaves it set for the key of C. The changed operation of the key signature actuator results in the transmission of a different set of standard pitch numbers N to the sound module, called here secondary standard pitch numbers, which are shown in FIG. 12. Referring to FIG. 12, at the top of the table are the same written notes and keyboard digitals as in FIG. 11, but for each written note and its corresponding keyboard digital, the secondary standard pitch number N is one greater than the corresponding primary standard pitch number M shown in FIG. 11.

FIG. 13 shows secondary standard pitch numbers N for the middle octave of the keyboard for thirteen values of the uniform pitch changing parameter U, ranging from −7 to +6. For each digital the secondary standard pitch number N exceeds the primary standard pitch number M by the value of the uniform pitch changing parameter U.

A key signature to be actuated is selected by first stepping on a footswitch and simultaneously pressing one of fifteen musical key selecting front digitals of the keyboard. As indicated in FIG. 7, these fifteen front digitals run from the C3 digital for a key signature having seven flats to the C5 digital for a key signature having seven sharps. Shift switch 7, which is operated as a footswitch, has the effect of shifting the MIDI messages from these keyboard digitals to a set of electronic switches in key signature actuator 1, which serve to select a key signature. The electronic circuitry necessary to decode the MIDI messages and to address these switches is well known, the MIDI messages and pitch numbers received in commercial sound module 3 being used to address a similar set of electronic switches that select and sound different musical tones.

To select a key signature, one momentarily steps on footswitch 7 and simultaneously presses one of the key signature selecting digitals indicated in FIG. 7. For example, to actuate a key signature having two flats one presses the A3 front digital. To actuate a key signature having three sharps, one presses the F4 front digital. The fourteen traditional key signatures are tabulated in FIG. 8.

Referring to FIG. 8, the number of flats or sharps in a key signature are shown at the top of the table. The key note for each key signature is shown at the bottom of the table. The first column lists the seven notes of the basic diatonic scale in the standard key of C. The changes from each of these notes in the other musical keys is shown in the body of the table. FIG. 9 shows numerical corrections made by the key signature actuator for these other musical keys, relative to the standard pitch numbers for the key of C.

FIG. 9 is similar to FIG. 8 except that each flatted note in FIG. 8 is listed in FIG. 9 as a numerical correction of −1 to the primary or secondary standard pitch number for the key of C; each sharped noted in FIG. 8 is listed in FIG. 9 as a numerical correction of +1 to the standard pitch number for the key of C, for front digitals of the keyboard. When these corrections are made in the answering pitch numbers, all notes of the tonal diatonic scale can be played on the front digitals of the keyboard. The non-diatonic notes will be played on the back digitals. For key signatures containing up to five sharps or flats a front digital and a back digital on its right or left simply interchange their standard pitch numbers. Thus for key signatures containing sharps any key signature sharped note voided by a natural sign must be played like a sharp on the back digital to the right of the designated front digital. Similarly, for key signatures containing flats any key signature flatted note voided by a natural sign must be played like a flat on a back digital to the left of the designated front digital.

For back digitals of the keyboard, FIG. 10 shows the numerical corrections to the standard pitch numbers for the key of C. The corrected numbers always sound a mode of the tonal pentatonic scale. For a key signature having five or seven flats or sharps, the overall pitch of the scale is lowered or raised by a semitone, but the interdigital musical intervals will be the same as they are in the standard key of C. By adding the numerical corrections of FIG. 9 to standard pitch numbers shown in FIGS. 11 and 12, we obtain the pitch numbers shown in FIGS. 15 and 16.

Referring to FIG. 15, the top rows show S, the number of sharps in the different key signatures, and the uniform pitch changing parameter U which is here equal to zero. The first column shows letter labels and note or digital identifying numbers for a sequence of eight consecutive front digitals, which normally play notes of the basic diatonic scale in the key of C. Each column in the body of the table shows the associated pitch numbers transmitted from the key signature actuator to the sound generator, and the seven differences from one to another between the successively increasing pitch numbers. In the musical keys of C and C sharp the sequence of seven differences 2-2-1-2-2-2-1 corresponds to the sequence of intertone musical intervals 2-2-1-2-2-2-1 for the major mode of the diatonic scale. The sequences of differences in the other six columns correspond to the intertone musical intervals for other modes of the diatonic scale, which are listed, for example, in my U.S. Pat. No. 3,986,422, column 9. Sounding different modes of the diatonic scale using only seven or eight musical notes is an essential function of key signatures, and of key signature actuators.

FIG. 16 shows the pitch numbers for the same musical keys and the same basic musical notes and front digitals. These pitch numbers have all been increased by addition of the uniform pitch changing parameter U, which is here equal to one, but the pitch numbers for S=0 are still termed "standard pitch numbers" for the standard key of C. The sequences of seven differences in FIG. 16 are exactly the same as in FIG. 15, for a uniform change of pitch has no effect on the intertone musical intervals of a musical scale, in any of its modes. Pitch numbers for six back digitals of the keyboard, obtained by adding the corrections of FIG. 10 to standard pitch numbers from FIG. 11, are shown in FIGS. 17 and 18.

Referring to FIG. 17, the top rows show S, the number of sharps in the different key signatures, and the uniform pitch changing parameter U which is here equal to zero. The first column shows letter labels and note or digital identifying numbers for a sequence of six consecutive back digitals, which normally play notes of the chromatic scale that are intermediate to notes of the basic diatonic scale in the key of C. Each column in the body of the table shows the associated pitch numbers transmitted from the key signature actuator to the sound generator, and the five differences between consecutive pitch numbers. The pitch numbers are arranged in order of increasing integers. successively increasing pitch numbers.

For a key signature containing zero, five or seven sharps the sequence of five differences between consecutive pitch numbers corresponds to the sequence of intertone musical intervals for the same mode of the tonal pentatonic scale. The sequences of difference in the other five columns correspond to the intertone musical intervals for other modes of the tonal pentatonic scale.

FIG. 18 shows the pitch numbers for the same six chromatic notes and back digitals, but for key signatures of flats. Again, for a key signature containing five or seven flats the sequence of five differences is the same as it is for the standard key of C. For key signatures where the sum F+S is equal to five, the sequences of differences are the same in FIG. 18 as in FIG. 17, these differences corresponding to the intertone musical intervals for different modes of the tonal pentatonic scale.

The key signature actuator could aid music playing even on a musical instrument having a single row of digitals, which could normally play either the diatonic scale or the tonal pentatonic scale in the key of C. For illustration, FIG. 19 shows a MIDI equipped musical instrument which transmits "Note On" messages on output terminal 26, accompanied by numbers which identify notes of written music and the digitals that are playing them. This instrument has six digitals positioned consecutively, normally playing the sequence of notes C-D-E-G-A-C, which constitutes a mode of the tonal pentatonic scale. This is the same musical scale as that played by consecutive back digitals of the keyboard shown in FIG. 7, for a musical scale is characterized by its intertonal musical intervals, not just by the names of its notes. Here the row of six digitals has interdigital musical intervals of 2-2-3-2-3 semitones. In this musical instrument two digitals labeled "−1" and "+1" allow all of the notes of the tonal pentatonic scale to be flatted or sharped so as to sound twelve different tones in the octave. In addition, a digital labeled "−12" allows the pitch of the output music to be lowered by an octave. The digital labeled "+12" allows the pitch of the output music to be raised by an octave.

FIG. 20 shows a similar MIDI equipped musical instrument having a row of six digitals. These normally play the sequence of notes C-D-F-G-A-C, which constitutes another mode of the tonal pentatonic scale having the interdigital musical intervals 2-3-2-2-3. By using the additional row of four digitals which constitute a uniform pitch changer, the instrument can sound a continuous sequence of thirty-nine individual musical tones.

A look-up table of pitch numbers for the whole keyboard shown in FIG. 7 is constructed by applying the numerical corrections shown in both FIGS. 9 and 10 to the primary standard pitch numbers shown in FIG. 11. Referring to FIG. 21, the heading of the table shows F, the number of flats in a key signature, and S, the number of sharps in a key signature, and that the uniform pitch changing parameter U is equal to zero. The first column shows letter labels and digital numbers which identify musical notes of written music and their corresponding keyboard digitals. The top row and first column provide addresses for finding the pitch numbers. For example, for a key signature with four flats and for a digital number 74 the answering pitch number is equal to 73.

Thus if a musician sets the key signature actuator to a key signature having four flats, and then presses the D4 digital, its associated digital number 74 will be transmitted to the key signature actuator, receive the keyboard digital number 74. For this digital number the associated pitch number is 73, which sounds the tone of D flat. If the musician has need to play the D natural note, he must press the D4 flat back digital, which will transmit its associated digital number 73. Inspection of FIG. 21 shows that for this digital number the associated pitch number is 74, which indeed sounds the D natural tone. (The tone sounded by the D digital when the key signature actuator is set for the key of C.)

The fifteen states of the number changer are classified according to a number J, which represents the number of sharps or flats in the different key signatures, and by the keynotes corresponding to the individual key signatures. For values of J up to five the number of positive changes in FIG. 10 is equal to the number of negative changes in FIG. 9, and the number of negative changes in FIG. 10 is equal to the number of positive changes in FIG. 9. For values of J up to five, each of J pitch numbers per octave exceeds by exactly one the standard pitch number, each of J pitch numbers per octave is less by exactly one than the standard pitch number, and each of the remaining 12-2J pitch numbers per octave is exactly equal to the standard pitch number.

Figures 22, 23:
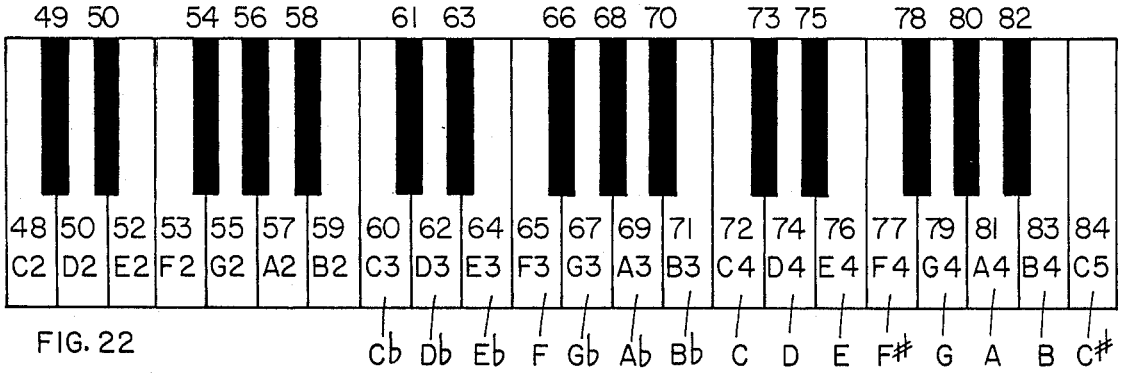

The look-up table of pitch numbers in this key signature actuator can be accessed in two different ways. If a musician prefers to select key signatures according to the number of sharps or flats they contain, he presses the pushbutton labeled J on the keyboard, and thereafter selects key signatures on this basis, as shown in FIG. 7. If he prefers to select musical keys according to their keynotes, he presses the pushbutton labeled K, and thereafter selects musical keys according to their keynotes, as shown in FIG. 22. Referring to FIG. 22, keynotes corresponding to key signatures with flats are selected by front digitals C3 to B3. Keynotes corresponding to key signatures with sharps are selected by front digitals D4 to C5.

The array of pushbuttons 8 on the keyboard can be used to select different values of the uniform pitch changing parameter U. This parameter is added to the primary standard pitch numbers shown in FIG. 11 to produce secondary standard pitch numbers such as those shown in FIGS. 12 and 13. And a uniform numerical change up or down in the standard pitch numbers for the key of C naturally produces equal changes in the transmitted pitch numbers for each key signature, as shown in FIG. 23.

The look-up table of FIG. 23 is like that shown in FIG. 21 except that here the value of the pitch changing parameter U is equal to one and all pitch numbers for all musical keys are greater by one than they are in FIG. 21. The value "one" for the pitch changing parameter U is selected by pressing the pushbutton labeled "1" in the pushbutton array 8 shown in FIG. 7. Similarly, six other values of the pitch changing parameter U ranging from −3 to +4 can be selected by pressing different pushbuttons in array 8.

The eight different look-up tables for different values of U are stored and retrieved independently of each other, so that the slight delay incurred in receiving a digital number and answering it with a pitch number is the same as if there were no change of overall pitch, but only actuation of a key signature.

Changes in the uniform pitch changing parameter U never affect the fingering of a musical composition. On the other hand, changes in the values of F or S within the range zero to +6 always affect the fingering of a musical composition. By effecting a uniform pitch change in a key signature actuator in this way we avoid any extra sound delay during musical performance that could be caused by a separate uniform pitch changer.

After selecting a key signature of written music, a keyboard musician can play musical notes as they appear in the body of the written music, unmodified by any key signature. Being relieved of this detail, he can give more attention to expressive aspects of the music.

For a key signature with seven flats, the front and back digitals will be played in exactly the same way as in the key of C, with all flats automatically actuated. For the other key signatures of flats, when a front digital is playing a key signature flatted note, its chromatic "natural" note is played by the closest back digital at its left on the keyboard.

For a key signature with seven sharps, the front and back digitals are played in exactly the same way as in the key of C, with all sharps automatically actuated. For the other key signatures of sharps, when a front digital is playing a key signature sharped note, its chromatic "natural" note is played by the closest back digital at its right on the keyboard.

Equipment suitable for computing, storing, and retrieving numbers is widely available in the computer industry. Widely available also in the music industry is MIDI equipped apparatus for transmitting and receiving MIDI messages, storing numbers, retrieving them, and transmitting them to a sound generator via a MIDI cable. As an example, FIG. 24 is a block diagram of commercial equipment suitable for both storing tables of pitch numbers and using them for actuating key signatures automatically.

Figures 24, 25, 26, 27, 28:
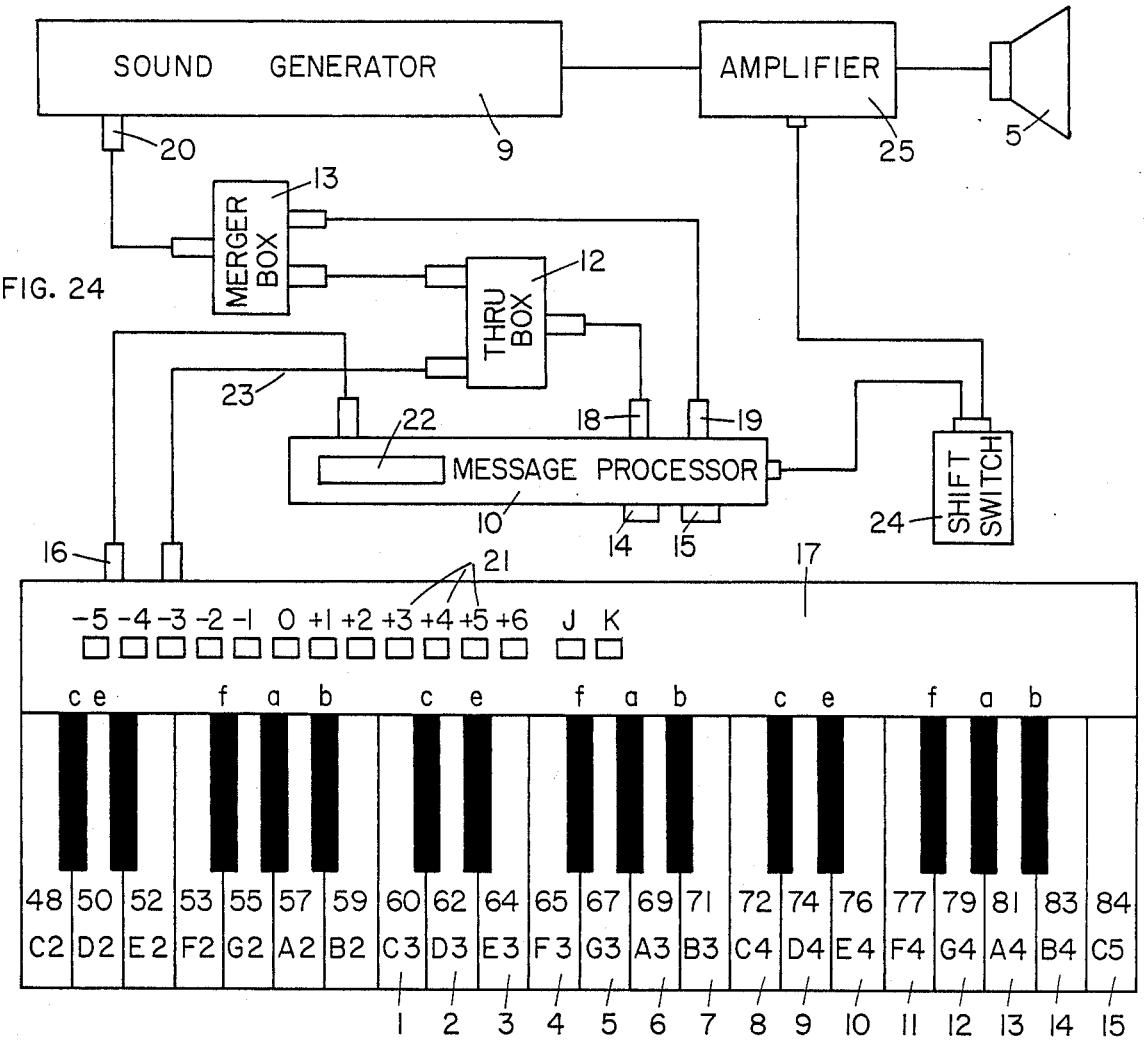
FIG. 24 is a block diagram of commercially available musical equipment which is suitable for actuating key signatures.
FIG. 25–28 show displays visible in the commercial equipment when storing a look-up table of pitch numbers for different key signatures.

Referring to FIG. 24, sound generator 9 is a Roland MKS 50 Sound Module which generates musical tones electronically and transmits them to amplifier 25 and loudspeaker 5. MIDI message processor 10 is marketed by Axxess Unlimited under the trademark MAPPER TM. Keyboard 17 is part of a Casio CZ-3000 Synthesizer having an array of pushbuttons 21 intended for selection of musical voices, but which can additionally be used to control the MIDI message processor. This message processor receives "Note On" and "Note Off" MIDI messages, each accompanied by one or more note and digital identifying numbers for keyboard 17. The message processor has a MAIN pushbutton 14, a SUB pushbutton 15, and a display 22. Shift switch 24 for the message processor is operated as a footswitch, which also opens a circuit to loudspeaker 5. This latter feature is a modification of the commercial equipment to prevent the loudspeaker from sounding a musical tone when a key signature is being selected. Thru box 12 is a Roland NM-4 unit, used to get MIDI feedback to the keyboard. Merger Box 13 is marketed by J. L. Cooper Electronics under the trademark MIDI BLENDER TM. This is needed to merge the two outputs 18, 19 from the MIDI message processor for the present application.

Although the commercial equipment of FIG. 24 receives, stores, and transmits binary coded numbers, display 22 identifies these transactions by their MIDI equivalent letter codes. Letter codes for notes of the basic diatonic scale and their corresponding front digitals of the keyboard are the upper case letters C, D, E, F, G, A, B. Codes for intermediate notes and back digitals C sharp, E flat, F sharp, A flat, B flat are the lower case letters c, e, f, a, b respectively.

A look-up table of pitch numbers like that shown in FIG. 21 can be stored using the equipment of FIG. 24 as follows. Main pushbutton 14 in the message processor is pressed to select a Main Menu named "NOTE", then sub pushbutton 15 is used to select a Sub Menu named "PLAY". Starting in FIG. 21 at the bottom of column 1, to store an address of the pitch numbers for the C2 digital number, footswitch 24 is depressed and the C2 keyboard digital is pressed, then the pedal is released. Display 22 shows the digital code C2 as in FIG. 25. Now the fifteen pitch numbers associated with the C2 digital number are entered in accordance with the lowest line of key signature changes in FIG. 8, by pressing the B1 digital twice, the C2 digital seven times, and the C2 sharp digital six times. These pitch codes will be seen in display 22, as shown in FIG. 26. The rest of the look-up table for front digitals can be entered in the same way, as indicated in FIG. 8.

To store the address of pitch numbers for the C2 sharp digital number, press the C2 sharp back digital simultaneously with footswitch 24. The display responds as shown in FIG. 27. Pitch codes for the intermediate notes and back digitals are entered by using a table of key signature changes for the chromatic notes, which is shown in FIG. 29. As shown in the bottom line of key signature changes in FIG. 29, the fifteen pitch numbers for the C2 sharp digital number are entered by pressing the C digital once, the D digital three times, the c digital five times, the C digital five times, and the D digital once. The display responds as shown in FIG. 28. The rest of the look-up table for back digitals can be entered in the same way, as indicated in FIG. 29.

We must now provide means for selecting one of the key signatures and for retrieving the stored pitch numbers for that key signature. A convenient way to do this on the commercial equipment is to assign the fifteen musical keys to fifteen of the sixteen MIDI "channels" which are identified by four binary digits in the "Note On" and "Note Off" messages. MIDI message processor 10, which is designed for use with a musical keyboard, selects these MIDI channels on the fifteen front digitals C3 to C5 of the keyboard, as shown in FIG. 24. We can select a key signature by pressing one of the front digitals C3 to C5, either according to the number of flats or sharps in the key signature, or according to its keynote. The method of selecting a key signature will be determined by pressing a pushbutton marked either J or K in FIG. 24.

To implement an association between key signature selections and MIDI channels, we use sub pushbutton 15 to get the SPLT sub menu. In accordance with FIG. 7, we start with the key signature having seven flats by depressing the footswitch and simultaneously the C3 front digital. This selects channel 1, as seen in FIG. 30. Because the MIDI message processor allows different parts of the keyboard to be "split" and treated differently, we must simultaneously press the extreme left and extreme right keyboard digitals to indicate that for our purpose the whole keyboard is to be treated in the same way. Display 22 responds as shown in FIG. 31. Now sub pushbutton 15 is pressed a second time simultaneously with depression of the footswitch, giving a second level SPLT display as shown in FIG. 32. Referring to FIG. 32, asterisks numbered one to fifteen indicate the succession of key signature changes shown in FIGS. 26 and 28, which have been associated respectively with the fifteen columns of pitch codes in FIGS. 8 and 29 in making the complete look-up table like that of FIG. 21.

In order to assign only the first column of pitch codes in the look-up table to the present channel one, we must leave the first asterisk and remove the other asterisks. We do this by omitting the digital with the C3 digital code and pressing all the channel selection digitals to its right on the keyboard. This toggles off fifteen of the asterisks, leaving the one asterisk at address no. 1, as shown in FIG. 33. This address corresponds to the first column of key signature changes in FIG. 21. Thus the key signature with seven flats has now been assigned to MIDI channel 1, which will be selected by the C3 front digital of the keyboard.

In accordance with FIG. 7, we next assign the key signature with six flats by pressing the D3 digital simultaneously with the footswitch. This selects channel 2. Then the whole process for channel 1 is repeated for channel 2, leaving an asterisk in the second position as shown in FIG. 34. In accordance with FIG. 7, we can assign the key signature with four sharps by pressing the G4 digital simultaneously with the footswitch. This selects channel 12. Then the whole process for channel 1 is repeated for channel 12, leaving an asterisk in the twelfth position, as shown in FIG. 35. And so on for the other key signatures.

The complete look-up table and key signature selection process have now been stored in a buffer memory of the message processor. For permanent storage, use the two pushbuttons 14, 15 to get the MAPS main menu and the SAVE sub menu. To save this method of key signature selection as MAP J2, press the pushbutton marked "J" on the keyboard, the pushbutton marked "2" in array 21, and any front digital of the keyboard. Display 22 now says "DONE!".

To ready the apparatus for key signature actuation, depress the footswitch and simultaneously press main pushbutton 14 and then sub pushbutton 15 to get the RUN/MIXER mode. Then to load MAP J2 for action, press the pushbuttons marked "J" and "2" on the keyboard.

Finally, to select a key signature for actuation, depress the footswitch and simultaneously press the appropriate front digital, as indicated in FIG. 7. To select the key of C, for example, press the C4 front digital. Or to select a key signature having four sharps, press the fourth front digital to the right of the C4 digital. Display 22 will indicate which MIDI channel has been selected, and therefore which key signature is being actuated. For example, in FIG. 36 the "S" (For "SOLO") indicates channel 10 and that the single key signature with two sharps has been selected.

Music composers and some trained musicians may prefer to select key signatures on the basis of their keynotes. This basis of selection is provided on the keyboard front digitals as shown in FIG. 22. For this arrangement the columns of pitch numbers in the look-up table must be assigned differently to the fifteen musical key selection digitals on the keyboard.

In accordance with FIG. 22, the key of C flat should be selected by the C3 front digital as before, using the first level NOTE/SPLT menu. Next, to select the key of D flat on the D3 digital, in accordance with FIG. 22, we press the footswitch and simultaneously the D3 digital. This selects channel 2. As before, the C2 and C5 digitals must be pressed simultaneously for channel 2, and then the footswitch and the D3 pushbutton simultaneously depressed a second time to get the second level SPLT menu. This time, to get corrections of the key of D flat as shown in the bottom line of FIG. 8, the asterisk must be left in the third position. Display 22 responds as shown in FIG. 37.

Next, to select the key of E flat on the E3 digital, in accordance with FIG. 22, we press the footswitch and simultaneously the E3 digital. This selects channel 3. This time, in accordance with the bottom line of FIG. 8, the asterisk is left in the fifth position. Display 22 responds with the assignment for the key of E flat to channel 3, as shown in FIG. 38. And so on for all fifteen musical keys. To store the table of pitch numbers and key signature selection process more permanently, use pushbuttons 14, 15 to get the MAPS/SAVE menu. This method of key signature selection can be saved as MAP K3 by pressing the pushbutton marked "K" in FIG. 24, the pushbutton marked "3" in array 21, then any front digital of the keyboard.

To get the RUN/MIXER mode for action, depress the footswitch and simultaneously press main pushbutton 14 and then sub pushbutton 15, then release the pedal. To load MAP K3, press the pushbuttons labeled "K" and "3" on the keyboard.

FIG. 22 shows that keynotes for key signatures with flats are selected in the lower octave and keynotes for key signatures with sharps are selected in the upper octave. To select a key signature for actuation, press the appropriate keyboard digital while simultaneously depressing the footswitch. Again display 22 will indicate which MIDI channel has been selected, and therefore which key signature is being actuated. For example, in FIG. 39 the "S" indicates that the key signature for the key of D flat is being actuated. In FIG. 40 the "S" indicates that the key signature for the key of E flat is being actuated.

Whereas the displays shown in FIGS. 37 and 38 indicate what columns of a look-up table have been assigned to particular MIDI channels, the displays in FIGS. 39 and 40 show which solo channels and therefore which single key signatures have been selected.

OTHER EMBODIMENTS

Instead of storing pitch numbers for all values of the pitch changing parameter U, these can be stored for just the zero value of U. After a key signature has been selected, the thirty-seven stored pitch numbers for that key signature can be moved to a small, static, rapidly accessible memory before the keyboard playing begins. Then when a non-zero value of U is selected, that value of U can be added to each of these thirty-seven pitch numbers, and the results returned to the small fast memory. Thus when play on the keyboard is started there will not be a noticeable delay in retrieving the pitch numbers from the fast memory, and transmitting them to the sound generator.

The number changer can be packaged with a MIDI merger box such as that shown in FIG. 24, with multiple MIDI inputs and a single MIDI output. Or the key signature actuator can have multiple MIDI outputs, as indicated in FIG. 7. And it can have both multiple MIDI inputs and multiple MIDI outputs. These combinations tend to eliminate sequential MIDI receivers and the sound delay times they can introduce into musical performance.

The apparatus can be used to actuate key signatures on musical instruments having only a single row of digitals, such as some MIDI equipped wind instruments. The apparatus can even be used to actuate key signatures on MIDI equipped instruments such as guitars having only strings and frets to send the "Note On" messages and numbers which identify the different notes of written music.

Instead of receiving and transmitting binary coded numbers serially through a cable containing a single pair of wires, the key signature actuator can receive and/or transmit binary coded numbers serially through a fiber optic cable, or through the air by modulation of an optical or radio signal. In all of these embodiments of the invention, the key signature actuator still receives binary coded MIDI messages and binary coded note and digital identifying numbers serially on a first pair of electrical conductors, and transmits binary coded MIDI messages and binary coded pitch numbers serially on a second pair of electrical conductors.

Many keyboards have a MIDI transmitter for sending messages out and a MIDI receiver for receiving messages from another keyboard, for generating sound on an internal sound generator contained within the first keyboard enclosure. With this first keyboard, the key signature actuator can receive from the keyboard MIDI messages and digital identifying numbers transmitted in binary code serially on a first MIDI cable, actuate a key signature, and send answering MIDI messages and pitch numbers in binary code serially on a second MIDI cable back to the same keyboard, to sound on its own internal sound generator.

I claim:

1. An improved key signature actuator for a musical instrument having a group of at least six digitals and means for transmitting numbers to identify the digitals when they are pressed, each of the numbers being transmitted in binary code serially, the improvement comprising:

a first pair of electrical conductors, receiving means for receiving six digital numbers in binary code serially on the first pair of electrical conductors, a second pair of electrical conductors, transmitting means for transmitting fifteen pitch numbers in binary code on the second pair of electrical conductors, the fifteen pitch numbers constituting a succession of integers having an increase of one between consecutive members of the succession, a number changer connected electrically to the receiving means and the transmitting means, the number changer having a plurality of states in each of which six of the pitch numbers are associated with the six digital numbers, one pitch number to each digital number, the six pitch numbers constituting a series of integers having a sequence of positive differences between consecutive members of the series, the plurality of states including a first state wherein the sequence of differences is 2-2-3-2-3, the plurality of states including a second state wherein the sequence of differences is 2-3-2-3-2, means for selecting from the plurality of states of the number changer a single state.

2. The key signature actuator of claim 1 in which the plurality of states of the number changer includes a state wherein the sequence of differences is 3-2-2-3-2.

3. The key signature actuator of claim 2 in which the plurality of states of the number changer includes a state wherein the sequence of differences is 3-2-3-2-2.

4. The key signature actuator of claim 1 in which the plurality of states of the number changer includes a state wherein the sequence of differences is 2-3-2-2-3.

5. An improved key signature actuator for a musical instrument having means for transmitting note numbers to identify notes of written music, each note number being transmitted in binary code serially, the improvement comprising:

a first pair of electrical conductors, receiving means for receiving six note numbers in binary code serially on the first pair of electrical conductors, a second pair of electrical conductors transmitting means for transmitting fifteen pitch numbers in binary code on the second pair of electrical conductors, the fifteen pitch numbers constituting a succession of integers having an increase of one between consecutive members of the succession, a number changer connected electrically to the receiving means and the transmitting means, the number changer having a plurality of states in each of which six of the pitch numbers are associated with the six note numbers, one pitch number to each note number, the six pitch numbers constituting a series of integers having a sequence of positive differences between consecutive members of the series, the plurality of states including a first state wherein the sequence of differences is 2-2-3-2-3, the plurality of states including a second state wherein the sequence of differences is 3-2-2-3-2, means for selecting from the plurality of states of the number changer a single state.

6. The key signature actuator of claim 5 in which the plurality of states of the number changer includes a state wherein the sequence of differences is 2-3-2-3-2.

7. The key signature actuator of claim 6 in which the plurality of states of the number changer includes a state wherein the sequence of differences between consecutive pitch numbers is 2-3-2-2-3.

8. The key signature actuator of claim 5 in which the plurality of states of the number changer includes a state wherein the sequence of differences is 3-2-3-2-2.

9. An improved key signature actuator for a musical keyboard having twelve digitals arranged in a single sequence running from left to right, the twelve digitals including seven front digitals and five back digitals, the second, fourth, seventh, ninth and eleventh digitals being back digitals, each of the twelve digitals having associated with it an identifying digital number, when each of the digitals is pressed its associated digital number being transmitted in binary code serially, the improvement comprising:

a first pair of electrical conductors, receiving means for receiving twelve digital numbers in binary code serially on the first pair of electrical conductors, a second pair of electrical conductors, transmitting means for transmitting twelve pitch numbers in binary code serially on the second pair of electrical conductors, a number changer connected electrically to the receiving means and the transmitting means, the number changer having a plurality of states in each of which the twelve pitch numbers are associated with the twelve digital numbers, one pitch number to each digital number, the plurality of states of the number changer including a standard state and at least three key signature states, each of the twelve pitch numbers having a standard value which it assumes in the standard state, each of the key signature states being classified according to a number J which is the number of sharps or flats in a musical key signature, each of 12-2J pitch numbers being exactly equal to its standard value, each of J pitch numbers exceeding its standard value by exactly one, each of J pitch numbers being less than its standard value by exactly one, the integer J assuming at least three values selected from the group consisting of the numbers 1, 2, 3, 4, 5, means for selecting from the plurality of states of the number changer a single state.

* * * * *